US010478961B2

(12) United States Patent
Barth et al.

(10) Patent No.: US 10,478,961 B2
(45) Date of Patent: Nov. 19, 2019

(54) HAND-HELD POWER TOOL WITH A SWITCHING UNIT

(71) Applicant: Robert Bosch GmbH, Stuttgart (DE)

(72) Inventors: Daniel Barth, Leinfelden-Echterdingen (DE); Cornelius Boeck, Kirchheim (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 370 days.

(21) Appl. No.: 15/598,983

(22) Filed: May 18, 2017

(65) Prior Publication Data

US 2017/0348843 A1 Dec. 7, 2017

(30) Foreign Application Priority Data

Jun. 2, 2016 (DE) ..... 10 2016 209 637

(51) Int. Cl.

| | |
|---|---|
| ***B24B 23/02*** | (2006.01) |
| ***B25F 5/02*** | (2006.01) |
| ***H01H 3/20*** | (2006.01) |
| *H01H 3/14* | (2006.01) |
| *H01H 9/06* | (2006.01) |

(52) U.S. Cl.

CPC ..... *B25F 5/02* (2013.01); *B24B 23/02* (2013.01); *B24B 23/028* (2013.01); *H01H 3/20* (2013.01); *H01H 3/14* (2013.01); *H01H 9/06* (2013.01)

(58) Field of Classification Search

CPC ..... H01H 3/04; H01H 3/14; H01H 3/122; H01H 3/20; H01H 1/18; H01H 13/08; H01H 9/06; H01H 9/047; B24B 23/02; B24B 23/022; B24B 23/028; B24B 23/141; B24B 55/00; B25F 5/00; B25F 5/001; B25F 5/008; B25F 5/02; B25F 5/029; B23B 45/02

USPC ..... 173/47, 216, 217, 162.2, 170, 171; 200/293.1, 321, 302.2, 332, 334, 310, 200/344, 522; 451/340, 344, 358, 359, 451/360

See application file for complete search history.

(56) References Cited

U.S. PATENT DOCUMENTS 3,873,796 A * 3/1975 Worobec, Jr. ..... H01H 3/20 200/332.2
4,381,037 A * 4/1983 Cuneo ..... B23B 45/02 173/170
5,065,476 A * 11/1991 Dohse ..... B24B 23/00 16/426

(Continued)

FOREIGN PATENT DOCUMENTS

DE 10 2011 089 718 A1 6/2013

*Primary Examiner* — Scott A Smith

(74) *Attorney, Agent, or Firm* — Maginot, Moore & Beck LLP

(57) ABSTRACT

A hand-held power tool, in particular an angle-grinding machine, includes a housing, a switching unit, a motor, and at least one first pivot unit and one second pivot unit. The switching unit includes a ratchet element arranged on the housing. The first and second pivot units are configured to mount the ratchet element on the housing so as to be movable. Each of the first and the second pivot units includes at least one housing-side bearing unit and one ratchet-side bearing unit. The hand-held power tool further includes a coupling unit configured to couple the first pivot unit with the one second pivot unit.

20 Claims, 11 Drawing Sheets

(56) References Cited

U.S. PATENT DOCUMENTS

| | | | | |
|---|---|---|---|---|
| 5,681,214 | A * | 10/1997 | Kleider | B23D 45/16 451/344 |
| 6,293,859 | B1 * | 9/2001 | Fink | B23D 45/16 451/344 |
| 7,186,940 | B1 * | 3/2007 | Wong | H01H 1/18 200/522 |
| 8,198,560 | B2 * | 6/2012 | Kimata | H01H 3/20 200/318.1 |
| 8,292,700 | B2 * | 10/2012 | Gallagher | B24B 23/022 310/62 |
| 8,550,181 | B2 * | 10/2013 | Kobayashi | H01H 13/06 173/217 |
| 9,278,426 | B2 * | 3/2016 | Numata | B24B 55/00 |
| 9,330,858 | B2 * | 5/2016 | Boeck | B24B 23/028 |
| 9,855,651 | B2 * | 1/2018 | Xin | B24B 23/028 |
| 2009/0104861 | A1 * | 4/2009 | Van Der Linde | B25F 5/02 451/344 |
| 2010/0018734 | A1 * | 1/2010 | Frauhammer | B25D 16/006 173/171 |
| 2010/0236801 | A1 * | 9/2010 | Furusawa | B25D 11/10 173/47 |
| 2011/0259719 | A1 * | 10/2011 | Park | F25D 23/126 200/310 |
| 2012/0048585 | A1 * | 3/2012 | Miyazawa | B23D 51/00 173/170 |
| 2014/0370792 | A1 * | 12/2014 | Boeck | B24B 23/028 451/359 |

* cited by examiner

HAND-HELD POWER TOOL WITH A SWITCHING UNIT

This application claims priority under 35 U.S.C. § 119 to patent application number DE 10 2016 209 637.0, filed on Jun. 2, 2016 in Germany, the disclosure of which is incorporated herein by reference in its entirety.

BACKGROUND

The disclosure relates to a hand-held power tool with a switching unit according to the following description.

DE 10 2011 089 718 A1 describes a power tool with at least one handle housing and one switching unit which comprises at least one ratchet element arranged on the handle housing, and with at least one bearing unit which is provided for the purpose of mounting the ratchet element so as to be movable at least relative to the handle housing, the bearing unit including a lever drive unit which is realized as a parallelogram drive unit.

The disadvantage of the bearing unit from the prior art is that the parallelogram drive unit requires a large installation space along the radial axis of the power tool.

SUMMARY

The object to provide a hand-held power tool with a switching unit where the bearing arrangement of the ratchet element requires less installation space along the radial axis is produced from the prior art.

The disclosure proceeds from a hand-held power tool, in particular an angle-grinding machine, including a housing, a switching unit which comprises a ratchet element arranged on the housing, a motor and at least one first pivot unit and one second pivot unit, which units are provided for the purpose of mounting the ratchet element on the housing of the hand-held power tool so as to be movable, wherein the first and the second pivot units include in each case at least one housing-side bearing unit and one ratchet-side bearing unit. It is proposed that the hand-held power tool includes a coupling unit which couples the first pivot unit with the second pivot unit.

The hand-held power tool is, in particular, a portable hand-held power tool which is able to be transported by an operator. The hand-held power tool comprises, in particular, a weight which is less than 40 kg, in a preferred manner less than 10 kg and in a particularly preferred manner less than 7 kg. The hand-held power tool is realized in a particularly preferred manner as an angle-grinding machine. However, it is also conceivable for the hand-held power tool to comprise a different configuration which appears sensible to the person skilled in the art, such as, for example, a configuration as a hammer drill and/or chisel hammer, as a drill, as a reciprocating saw, as a jigsaw, as a hedge trimmer, etc.

The housing of the hand-held power tool can be a single-part or multi-part housing which is realized for the purpose of receiving components of the hand-held power tool, such as, for example, a motor, in particular an electric motor, a transmission, the electronics, etc. In an advantageous manner, the housing includes at least one housing part which can be configured in a pot-like manner or rather in the manner of a hollow cylinder or with the housing in the manner of a half shell. In an advantageous manner, the housing of the hand-held power tool comprises at least one motor housing in which the motor is arranged, and one handle housing. The handle housing can be realized in a stem-shaped manner, gun-shaped manner or pot-shaped manner The handle housing is provided, in particular, for the purpose of providing on its outside surface a handle region which is realized so that the hand-held power tool is able to be held by a user.

The term "switching unit" is to define here, in particular, a unit which comprises at least one component, the ratchet element, which is directly actuatable by an operator of the hand-held power tool and is provided for the purpose of modifying a process and/or a state of a unit which is coupled with the switching unit as a result of actuation and/or as a result of inputting parameters. The ratchet element is preferably provided for actuating at least one switching element of the switching unit. In particular, the ratchet element can be operable by encompassing the housing, in particular the handle housing, of the hand-held power tool with the tips of the fingers or the inside surface of the hand. The ratchet element can comprise a control surface for this purpose. The control surface of the ratchet can comprise, in an advantageous manner, markings which signal the position of the control surface to the user of the hand-held power tool. The control surface can also comprise a special coating or rubber coating or surface structure or rather surface morphology which increases the adhesion of the hand of the operator, in particular, of the finger tips, to the control surface.

The term "bearing unit" is to define here, in particular, a unit which is provided for the purpose of delimiting a number of degrees of freedom of at least one component, the bearing unit comprising at least one bearing element which enables a guided movement of the component along and/or about at least one movement axis of the component. The bearing unit can be realized, in this connection, as a translation bearing unit and/or as a rotation bearing unit. The first and the second pivot units are mounted on the one side of the housing of the hand-held power tool and the first and the second pivot units are rotatably mounted on the ratchet element on the other side by means of, in each case, at least one bearing unit.

The term "pivot unit" is to be understood, in particular, as a unit which connects two components together so as to be movable, in particular, so as to be rotatory or rather rotational or translatory. In particular, the pivot unit connects the housing of the hand-held power tool to the ratchet element of the switching unit.

The pivot unit is rotationally connectable to the housing of the hand-held power tool by means of a housing-side bearing unit which can be realized, in particular, as a rotary bearing. The housing-side bearing unit consequently provides a housing-side rotational axis about which the pivot unit can move relative to the housing of the hand-held power tool. In addition, the pivot unit is rotationally connectable to the ratchet element by means of a ratchet-side bearing unit. The ratchet-side bearing unit consequently provides a ratchet-side rotational axis about which the ratchet element can rotate relative to the pivot unit.

The first and the second pivot units are coupled by means of the coupling unit in such a manner that a movement of the first pivot unit brings about a movement of the second pivot unit and vice versa. In particular, the coupling unit can be connected to the first and the second pivot units so as to be movable relative to the housing and to the ratchet element of the hand-held power tool. As a result of the coupling between the first and the second pivot units, a substantially constant movement can be realized in an advantageous manner when the ratchet element is actuated.

The expression "substantially constant movement" is to define here, in particular, a movement of the ratchet element in at least one direction where each point of the ratchet element carries out said same movement. On account of production tolerances and/or brought about by a bearing clearance, there can be a difference in sections covered by at least two points which are arranged at remote ends of the ratchet element. The difference in sections covered can be, in particular, at most 10 mm, in a preferred manner at most 5 mm and in a particularly preferred manner at most 2 mm.

By means of the configuration according to the disclosure of the power tool, an exact guiding of the ratchet element can be achieved in an advantageous manner during a movement as a result of actuation of the ratchet element. Consequently, a high degree of operating comfort can advantageously be achieved. A substantially constant movement of the ratchet, which is largely independent of a position of an actuating point which is actuated on the control surface of the ratchet, can be realized additionally in an advantageous manner.

The ratchet element of the hand-held power tool comprises in an advantageous manner a reduced engagement force as well as a large usable control surface. In particular, the ratchet element is realized so as to be operable with a tip of a finger, which increases the safety of the hand-held power tool.

The first and the second pivot units are arranged, in particular, at least in part along a parallel line to the control surface of the ratchet element. In particular, a parallel line to the axial axis of the hand-held power tool intersects both the first and the second pivot units. The installation height or rather the extent of the handle of the housing of the hand-held power tool can advantageously be kept small as a result.

The first and the second pivot units can include in each case a first arm which connects the housing-side bearing unit to the ratchet-side bearing unit, wherein the first arm of the first pivot unit is always movable parallel to the first arm of the second pivot unit. The first arm of the first pivot unit, in this case, then extends parallel to the first arm of the second pivot unit in particular when a line perpendicular to the housing-side and ratchet-side rotational axis of the first pivot unit runs parallel or co-axially to a line perpendicular to the housing-side and ratchet-side rotational axis of the second pivot unit.

In particular, a first straight line, which runs through the housing-side bearing unit and the ratchet-side bearing unit of the first pivot unit, and a second straight line, which runs through the housing-side bearing unit and a ratchet-side bearing unit of the second pivot unit, always run parallel or co-axially to one another. In an advantageous manner, the distance between the housing-side rotational axis or bearing unit and the ratchet-side rotational axis or bearing unit of the first arm of the pivot unit is the same for the pivot units of the hand-held power tool. A substantially constant movement of the ratchet element can be realized advantageously as a result of the parallel movement of the arms of the first pivot unit and of the second pivot unit.

The first and the second pivot units can comprise in each case one second arm which connects the housing-side bearing unit to a further bearing unit which is realized for the purpose of mounting, in particular, rotationally mounting, the coupling unit on the first and the second pivot units. In particular, the coupling unit is mounted on the pivot units by the further bearing unit of the first pivot unit and by the further bearing unit of the second pivot unit.

The axial extent of the coupling unit can correspond to the distance between the housing-side bearing unit of the first pivot unit and the housing-side bearing unit of the second pivot unit. In this case, the axial extent of the coupling unit is to be understood, in particular, as the distance between the further bearing unit of the first pivot unit and the further bearing unit of the second pivot unit.

The coupling unit can include a coupling element, wherein the coupling element can be realized, in particular, as a rod element, a plastics material part or a sheet metal bending part. The coupling element advantageously comprises at its ends bearing elements which interact with the further bearing unit, in particular a bearing element, of the pivot unit in such a manner that the coupling element is mounted by the first and the second pivot units. Efficient coupling of the rotational movement of the first pivot unit with the rotational movement of the second pivot unit can be realized in an advantageous manner as a result.

The first and the second pivot units can be mounted so as to be rotatable in such a manner that the rotational movement of the first pivot unit follows the rotational movement of the second pivot unit or is effected in the opposite direction. Following a rotational movement is to be understood in said context, in particular, as the angle through which the first pivot unit rotates about the housing-side rotational axis of the first pivot unit corresponding substantially to the angle through which the second pivot unit rotates about the housing-side rotational axis of the second pivot unit, the first and the second pivot units rotating clockwise about their respective housing-side rotational axes. A rotational movement in the opposite direction is to be understood in said context, in particular, as the angle through which the first pivot unit rotates about the housing-side rotational axis of the first pivot unit corresponding substantially to the angle through which the second pivot unit rotates about the housing-side rotational axis of the second pivot unit, one pivot unit rotating clockwise about its respective housing-side rotational axis whilst the other pivot unit rotates in an anticlockwise manner. In an advantageous manner, the rotation of the first pivot unit is effected at the same angular velocity as the rotation of the second pivot unit.

In addition, it is proposed that at least one of the housing-side and/or one of the ratchet-side bearing units of the first and/or of the second pivot units includes a linear guide. As a result of the linear guide, the number of degrees of freedom of the housing-side and/or the ratchet-side bearing unit can be advantageously increased by at least 1. As a result of the linear guide, at least one bearing element of the bearing unit is mounted so as to be linearly movable, in particular, so as to be linearly and rotationally movable. The linear guide extends advantageously perpendicular to a housing-side or ratchet-side rotational axis of the pivot unit, in particular, parallel to the axial axis of the hand-held power tool.

The first pivot unit can be spaced from the second pivot unit by at least a length of 25%, in particular, a length of at least 50%, of the axial extent of the ratchet element. In particular, the ratchet-side rotational axis of the first pivot unit can be spaced from the ratchet-side rotational axis of the second pivot unit by at least a length of 25%, in particular a length of at least 50%, of the axial extent of the ratchet element. The axial extent of the ratchet-side element is to be understood, in this case, as the length of the ratchet element along the axial axis of the hand-held power tool.

In at least one state of the power tool a switching element of the switching unit can be actuated in a translatory manner by the ratchet element or in a rotational manner by the first and/or the second pivot units. Translatory, in this case, is to be understood, in particular, as linearly or as a result of a linear movement. Rotational, in this case, is to be understood, in particular, as by means of a rotational movement. The first and/or the second pivot units can comprise a third arm which is realized for the purpose of acting upon or actuating the switching element of the switching unit. The switching unit is configured in an advantageous manner for the purpose of activating or deactivating an operating state of the hand-held power tool when the switching element is actuated.

In an alternative embodiment, the coupling unit can comprise a toothed wheel element. In an advantageous manner, the coupling unit comprises two toothed wheel elements which together form a gear drive in order to transmit the rotational movement of the first pivot unit to the second pivot unit and vice versa. As an example, the housing-side or the ratchet-side bearing units of the first and of the second pivot units can comprise a first and a second toothed wheel element. It is also conceivable for the coupling unit to comprise a third toothed wheel element which is arranged between the first and the second toothed wheel elements of the first and of the second pivot units. The third toothed wheel element can be rotatably mounted, for example in the housing or in the ratchet.

The angle between the first arm of the first and/or of the second pivot unit and the radial axis of the hand-held power tool can advantageously assume a value of between 60° and 120°, in particular a value of between 70° and 110°, in particular in the case of an embodiment of the coupling unit as a gear drive. A radial axis is to be understood, in this case, in particular, as an axis which extends perpendicular to the drive train or to the drive shaft of a hand-held power tool.

The first and the second pivot units can be realized with the coupling unit as a scissors lifting unit. The scissors lifting unit can be realized in an advantageous manner as a scissors lifting table unit. A purely translatory or linear movement of the ratchet element with constant lift can be realized as a result of the scissors lifting unit.

The angle between the first arm of the first and/or the second pivot unit and the axial axis of the hand-held power tool can assume a value of between 0° and 30°, in particular a value of between 0° and 20°, in particular where a coupling unit is realized as a scissors lifting unit. The axial axis of a hand-held power tool is to be understood, in particular, as an axis which extends along the drive train or the drive shaft of the hand-held power tool.

The hand-held power tool can comprise a resetting element, in particular a leg spring, which is realized for the purpose of providing a resetting force in opposition to an actuating direction of the ratchet unit. The resetting element can be arranged on the first and/or the second pivot unit. The resetting element can be realized in an advantageous manner as a spring element. As an alternative to this, the resetting element can also be arranged on the ratchet element. In said context, arranged on something is to be understood, in particular, as a positive locking and/or non-positive locking connection or a bearing arrangement. In an advantageous manner, the resetting element is mounted in the first or in the second pivot unit.

The first and the second pivot units can form a structural unit with the coupling unit and with the resetting element. A structural unit is to be understood, in particular, as an assembly, the assembly produced from the individual components being connected together as a result of a positive locking and/or non-positive locking connection or rather by means of bearing units in such a manner that the assembly is connectable as one unit to the housing of the hand-held power tool. In particular, the ratchet element can also be provided as a component of the structural unit.

BRIEF DESCRIPTION OF THE DRAWINGS

Further advantages are produced from the following description of the drawings. Exemplary embodiments of the disclosure are shown in the drawings. The drawing, and the description include numerous features in combination. The person skilled in the art will also look expediently at the features individually and form them into sensible further combinations.

The drawings are as follows.

DETAILED DESCRIPTION

Figure 1:
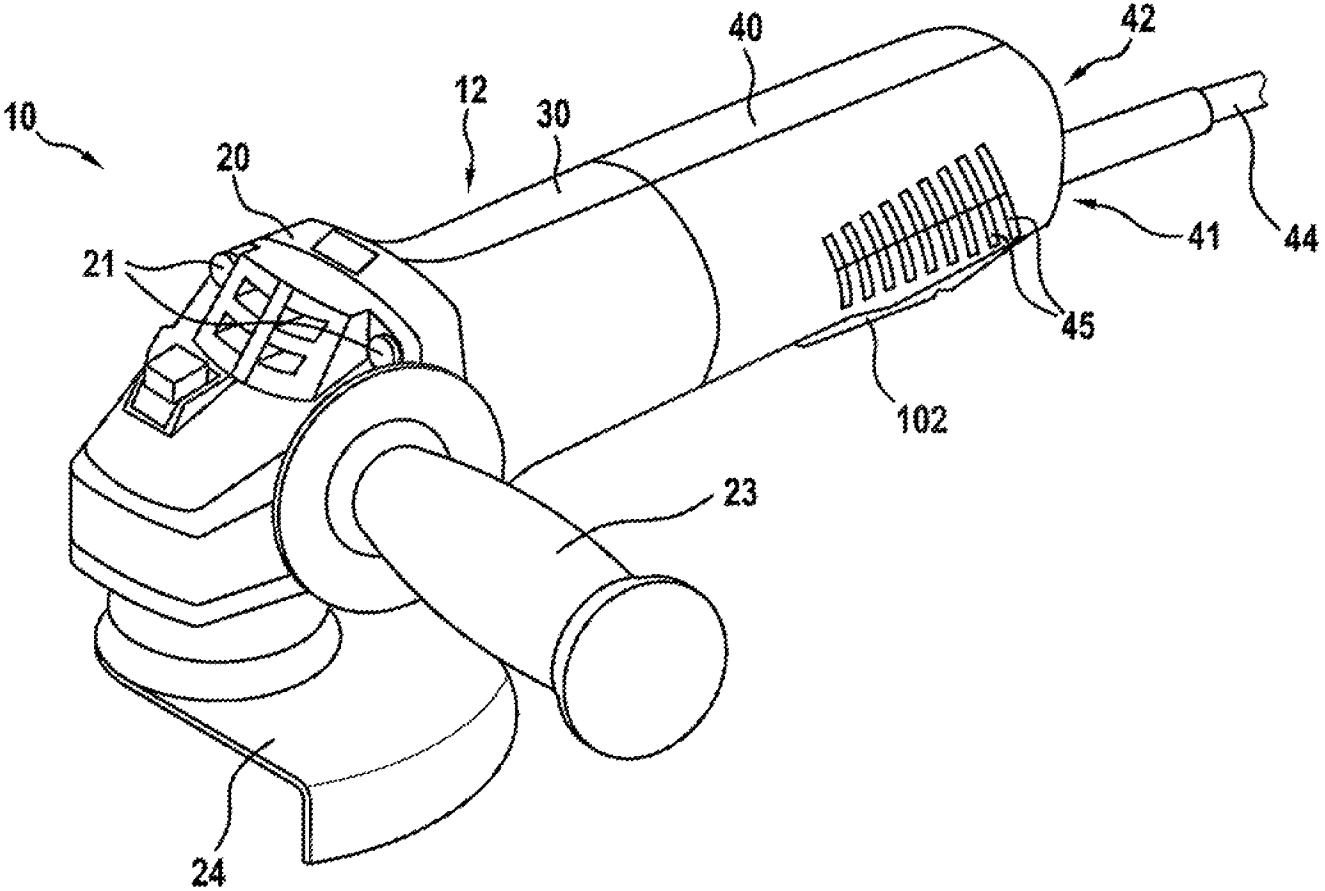
FIG. 1: shows a perspective view of a hand-held power tool.
Figure 2:
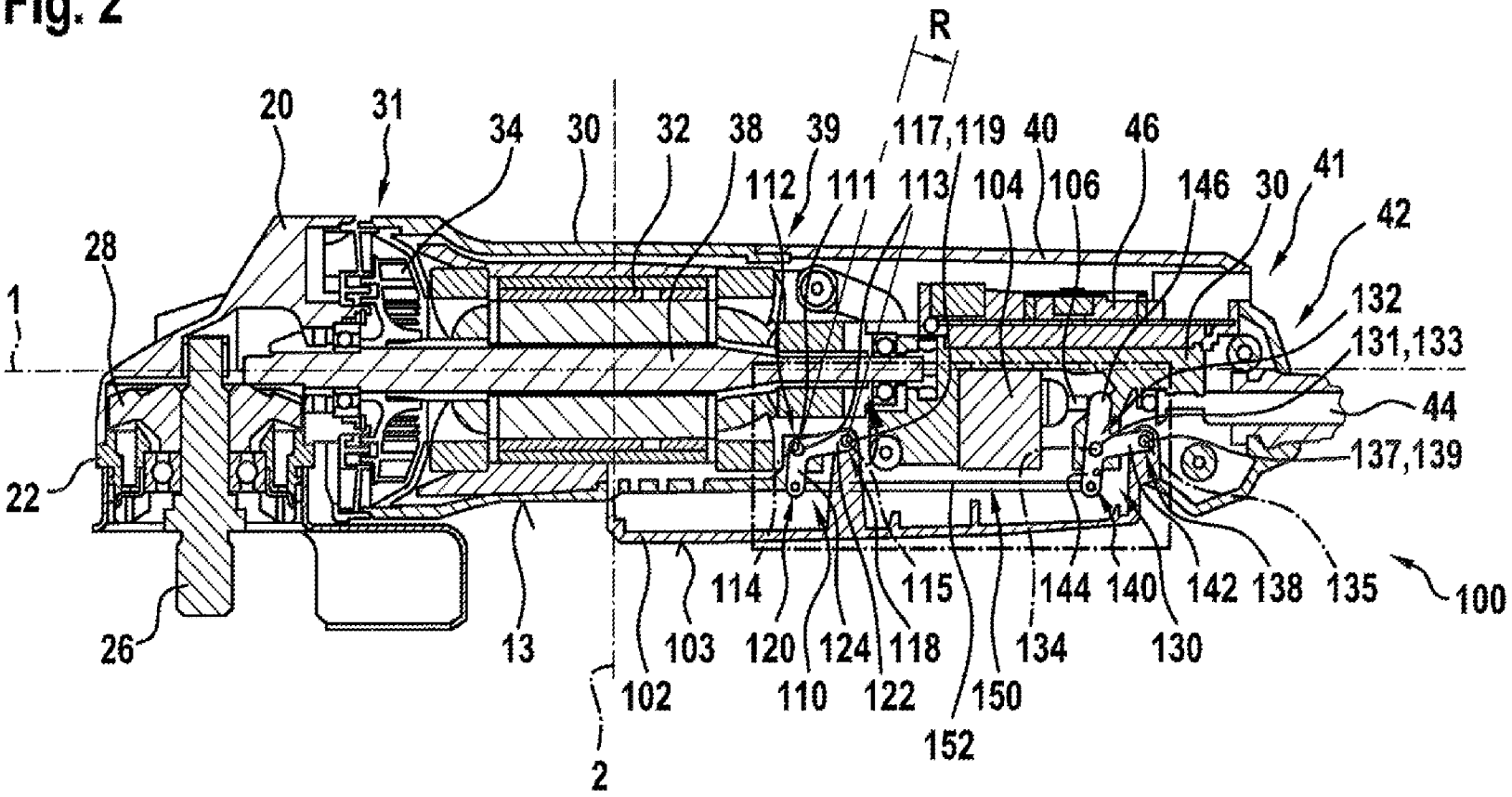
FIG. 2: shows a longitudinal section of a hand-held power tool with a ratchet element in the non-actuated state.
Figure 2A:
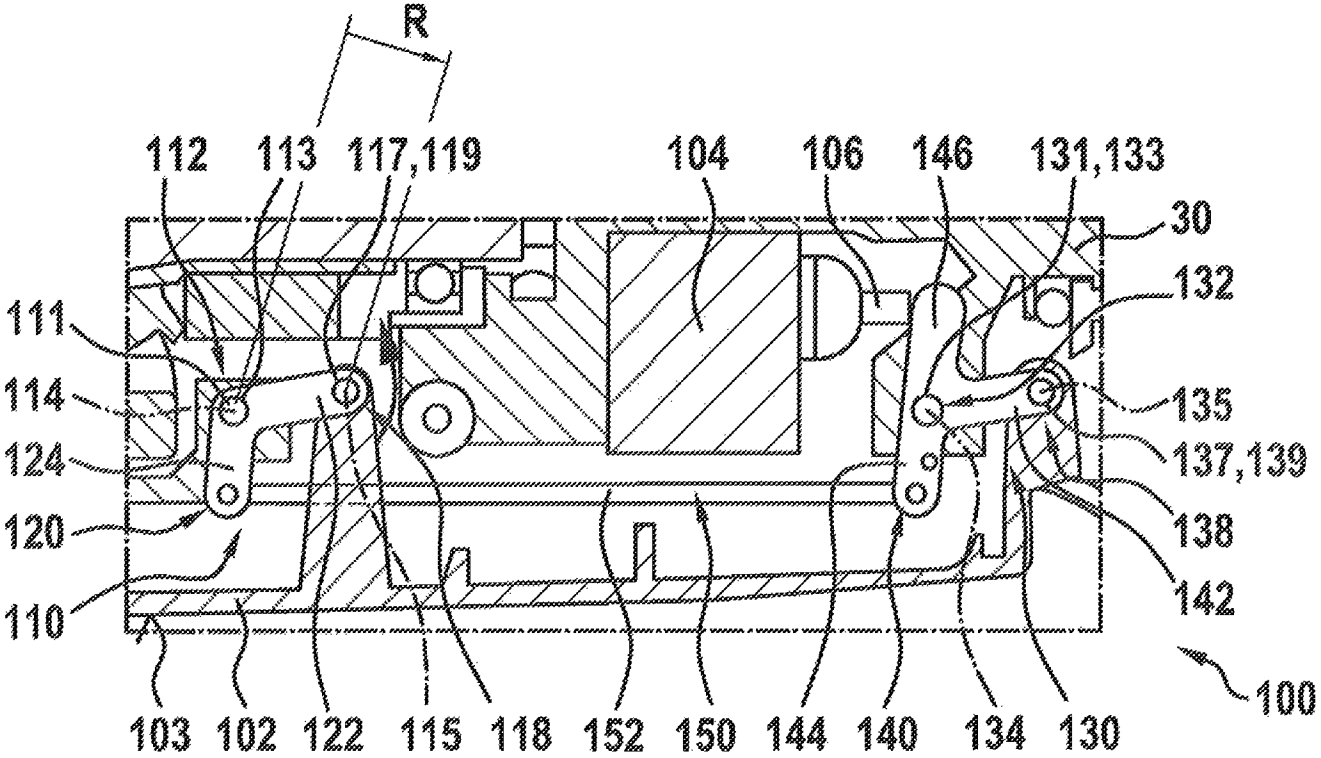
FIG. 2*a*: shows an enlarged detail of the hand-held power tool according to FIG. 2, FIG. 3: shows a longitudinal section of a hand-held power tool according to FIG. 2 with a ratchet element in the actuated state.

FIG. 1 shows a perspective view of a hand-held power tool 10 with a ratchet element 102. A longitudinal section of the hand-held power tool is shown in FIG. 2. The hand-held power tool 10 is realized, as an example, as an angle-grinding machine. The hand-held power tool 10 comprises a housing 12 which includes a gear head 20, a motor housing 30 and a handle housing 40. The gear head 20 can be produced from a metal and is fastened on the motor housing 30 by way of screws 21. An additional handle 23 is arranged, as an example, on the gear head 20. A receiving flange 22, on which a protective cover 24 is rotatably fastenable, is arranged on the bottom surface of the gear head 20. The receiving flange 22 comprises a central opening, through which an output spindle 26 is guided. The output spindle 26 is rotatably connectable or rather couplable with an insertion tool of the hand-held power tool 10, for example a cutting disk. The hand-held power tool 10 comprises an output side, the output spindle 26 emerging out of the housing 12 of the hand-held power tool 10 on the output side of the hand-held power tool 10.

The motor housing 30 includes, as an example, two portions. The first portion of the motor housing 30 is realized in the manner of a hollow cylinder. In particular, an electric motor 32 is arranged in the first portion of the motor housing 30. The first portion of the motor housing 30 is loosely connected to the gear head 20 on a first connecting region 31. A fan 34, which is realized for the purpose of generating a cooling air flow for cooling the electric motor 32, is arranged on the motor-housing-side in the first connecting region 31 of the motor housing 30. The electric motor 32 includes a drive shaft 38 which is coupled with the output spindle 26 by means of a crown wheel 28. The drive shaft 38 extends along the axial axis 1 of the hand-held power tool 10. In particular, the rotational axis of the drive shaft 38 corresponds to the axial axis 1 of the hand-held power tool 10. In the second connecting region 39 of the motor housing 30, the outside contour of the motor housing 30 merges into the outside contour of the handle housing 40. The handle housing 40 is realized as a housing cover or rather in a pot-shaped manner The handle housing 40 comprises lateral air inlet openings 45, through which the cooling air is able to enter into the housing 12 of the hand-held power tool 10. As an example, the handle housing 40 includes two housing half-shells which can be fastened together and to the motor housing by means of a fastening element, as an example screws. The second portion of the motor housing 30 is realized as a continuation which is encased by the handle housing 40. The second portion of the motor housing 30 is provided for the bearing arrangement or receiving of hand-held power tool components, in particular, the electronics 46, the switching unit 100 and the power supply unit 42. The hand-held power tool 10 is shown in the form of a mains-operated hand-held power tool which comprises a mains cable 44 for the power supply on the rear end 41 of the hand-held power tool 10. However, it is also conceivable for the power supply unit 42 to comprise a rechargeable battery pack interface which is connectable mechanically and electrically to a rechargeable battery pack interface of a rechargeable battery pack. A rechargeable battery pack is to be understood, in this case, as one or several battery cells which are connected together and are arranged in a housing. The housing of the rechargeable battery pack, in this case, comprises a rechargeable battery pack interface on its outside surface.

The switching unit 100 of the hand-held power tool 10 includes a ratchet element 102 and a switching element 104. The ratchet element 102 is arranged at least in part in a recess of the motor housing 30 and of the handle housing 40. The ratchet element 102 forms at least in part the outside contour 13 of the housing 12 of the hand-held power tool 10. The ratchet element 102 comprises a control surface 103, which is actuated by a user, in particular, by the fingertips of a hand of the user, for actuating the ratchet element 102. The transition from the outside contour 13 of the motor housing 30 to the outside contour 103 of the ratchet element 102, in particular of the control surface 103 of the ratchet element 102, is realized as a step. In an advantageous manner, the control surface 103 of the ratchet element 103 is realized so as to be identifiable by the hand of a user when it touches the step.

The ratchet element 102 is connected by means of a first pivot unit 110 and a second pivot unit 130 to the housing 12, in particular to the motor housing 30, of the hand-held power tool 10 so as to be movable.

The first and the second pivot units 110, 130 are connected to the housing 12, in particular to the motor housing 30, of the hand-held power tool in each case by means of a housing-side bearing unit 112, 113. The housing-side bearing unit 112, 132 comprises, as an example, a receiving bore 113, 133 which is provided for receiving a bolt or a pin 111, 131. The pin 111, 131 forms a housing-side rotational axis 114, 134 about which the first and the second pivot units 110, 130 are mounted in each case so as to be rotatable relative to the housing 12 of the hand-held power tool 10.

The first and the second pivot units 110, 130 are connected to the ratchet element 102 in each case by means of a ratchet-side bearing unit 118, 138. The ratchet-side bearing unit 118, 138 comprises, as an example, a receiving bore 119, 139 which is provided for receiving a bolt or a pin 117, 137. The pin 117, 137 forms a ratchet-side rotational axis 115, 135 about which the first and the second pivot units 110, 130 are mounted in each case so as to be rotatable relative to the ratchet element 102.

The housing-side rotational axis 114 of the first pivot unit 110 extends parallel to the housing-side rotational axis 134 of the second pivot unit 130. The ratchet-side rotational axis 115 of the first pivot unit 110 extends parallel to the ratchet-side rotational axis 135 of the second pivot unit 130. In particular, the housing-side rotational axes 114, 134 of the first and of the second pivot units 110, 130 extend parallel to the ratchet-side rotational axes 115, 135 of the first and of the second pivot units 110, 130.

Figure 4:
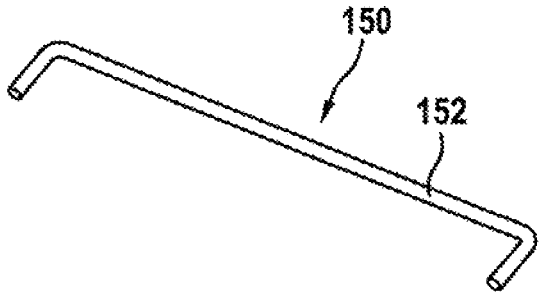
FIG. 4: shows a perspective view of a rod element.

The first and the second pivot units 110, 130 comprise in each case another further bearing unit 120, 140 which is realized for the purpose of mounting a coupling unit 150 at least in part. The coupling unit 150 is realized, as an example, as a rod element 152. As shown in FIG. 4, the rod element 152 is bent in an L-shaped manner at its ends. The L-shaped bent ends of the rod element 152 are mounted in the further bearing unit 120 of the first pivot unit 110 and in the further bearing unit 140 of the second pivot unit 130. The coupling unit 150 is realized for coupling the first pivot unit 110 with the second pivot unit 130. In particular, a rotational movement of the first pivot unit 110 about the housing-side rotational axis 114 is transmitted by the coupling unit 150 to a rotational movement of the second pivot unit 130 about the housing-side rotational axis 134.

The housing-side bearing units 112, 132 of the first and of the second pivot units 110, 130 are connected in each case to the ratchet-side bearing units 118, 138 of the first and of the second pivot units 110, 130 by means of a first arm 122, 142. The pivot units 110, 130 are formed, as an example, from a hard elastic plastics material. A second arm 124, 144 connects the housing-side bearing units 112, 132 of the first and of the second pivot units 110, 130 in each case to the further bearing units 120, 140 of the first and of the second pivot units 110, 130. The first 122, 142 arm is connected, as an example, to the second arm 124, 144, in particular is realized integrally or rather as one component.

The first arm 122, 142 and the second arm 124, 144 are arranged advantageously within an angular range of between 65° and 115° with respect to one another, as an example at an angle of substantially 90°. To calculate the angle, in this case, a straight line is produced through the first arm 122, 142, which line extends perpendicular from the housing-side rotational axis 114, 134 to the ratchet-side rotational axis 115, 135, and a straight line is produced through the second arm, which line extends perpendicular from the housing-side rotational axis 114, 134 to the rotational axis of the further bearing unit 120, 140.

The first arm 122 of the first pivot unit 110 is realized advantageously parallel to the first arm 142 of the second pivot unit 130. In addition, the distance between the housing-side bearing unit 112 of the first pivot unit 110 and the ratchet-side bearing unit 118 of the first pivot unit is realized so as to be substantially identical to the distance between the housing-side bearing unit 132 of the second pivot unit 130 and the ratchet-side bearing unit 138 of the second pivot unit 130, as a result of which a parallelogram arrangement is realized.

Figure 3:
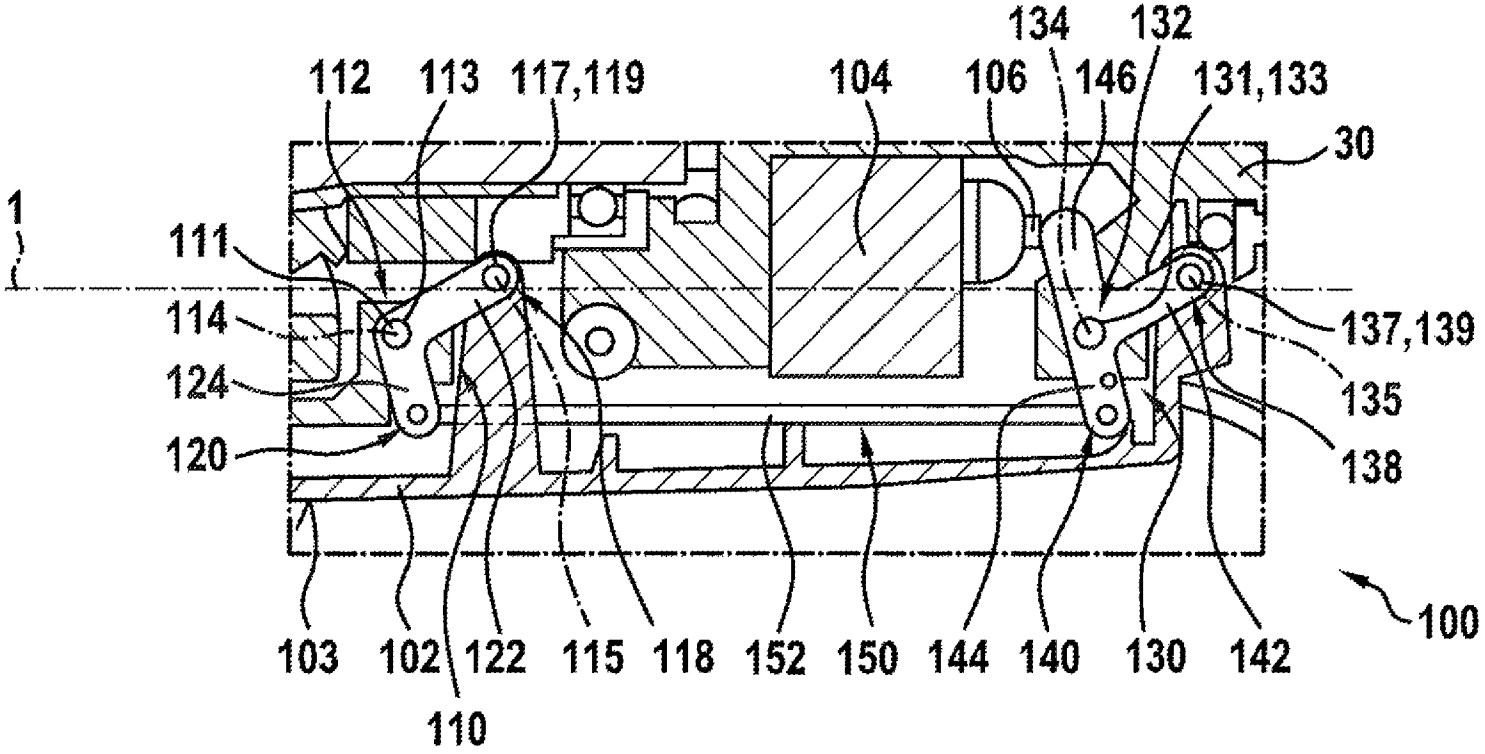

FIG. 2 and FIG. 3 show longitudinal sections of the hand-held power tool 10 in the non-actuated and the actuated state. An actuated state according to FIG. 3 is to be understood, in this case, as a state of the hand-held power tool 10 where the switching element 104 is actuated, whilst in the non-actuated state according to FIG. 2 the switching element 104 is not actuated. To actuate the switching element 104, the hand-held power tool 10 comprises, as an example, on the second pivot unit 130 an additional arm 146 which is realized for the purpose of actuating a push button 106 of the switching element 104 in the actuated state. A force is exerted onto the control surface 103 of the ratchet element 102 by a user of the hand-held power tool 10 to actuate the switching unit 100. The ratchet-side bearing units 118, 138 of the first and of the second pivot units 110, 130 are moved along an imaginary circular path which extends at a radius R about the housing-side rotational axes 114, 134 of the first and of the second pivot units 110, 130. The radius R corresponds, in this case, to the distance between the housing-side rotational axes 114, 134 and the ratchet-side rotational axes 115, 135 of the first and second pivot units 110, 310. When the ratchet element 102 is actuated, the first arms 122, 142 of the first and the second pivot units 110, 310 are moved parallel to one another and relative to the housing 12, in particular to the motor housing 30, of the hand-held power tool 10. As a result of said relative movement, the additional arm 146 of the second pivot unit 130 acts upon the push button 106 of the switching element. The force exerted as a result onto the push button 106 of the switching element 104 moves the switching unit 100 and consequently the hand-held power tool 10 into an actuated state.

The force to be expended to actuate the switching unit 100 is able to be advantageously reduced as a result of lever transmission. The force to be expended is produced from the ratio between the distance between the housing-side rotational axis 134 of the second pivot unit 130 and the ratchet-side rotational axis 135 of the second pivot unit 130, on the one side, and the distance between the housing-side rotational axis 134 of the second pivot unit 130 and the contact surface of the further arm 146 of the second pivot unit 130 on the push button 106 of the switching element 104, on the other side. A smaller engagement force is possible as a result of said transmission ratio. The two arms 142, 146 comprise, in particular, a length ratio of 12.7 mm to 16.5 mm with respect to one another. The stroke of the push button 106 of the switching element 104 is, as an example, 5 mm. Consequently, a stroke of 6.6 mm is produced, as an example, on the ratchet 102.

The first pivot unit 110 is spaced, in particular, in an axial manner, from the second pivot unit 130 by at least 35% of the axial extent of the ratchet element 102. In an advantageous manner, a substantially constant movement of the ratchet element 102 can be realized as a result of the mounting of the ratchet element 102 on the first and the second pivot units 110, 130. In particular, during actuation, the control surface 103 of the ratchet element 102 is moved toward the axial axis 1 in a manner substantially parallel to the axial axis 1 of the hand-held power tool 10. The axial axis 1 of the hand-held power tool extends through the drive shaft 38 of the motor 32.

Figure 5:
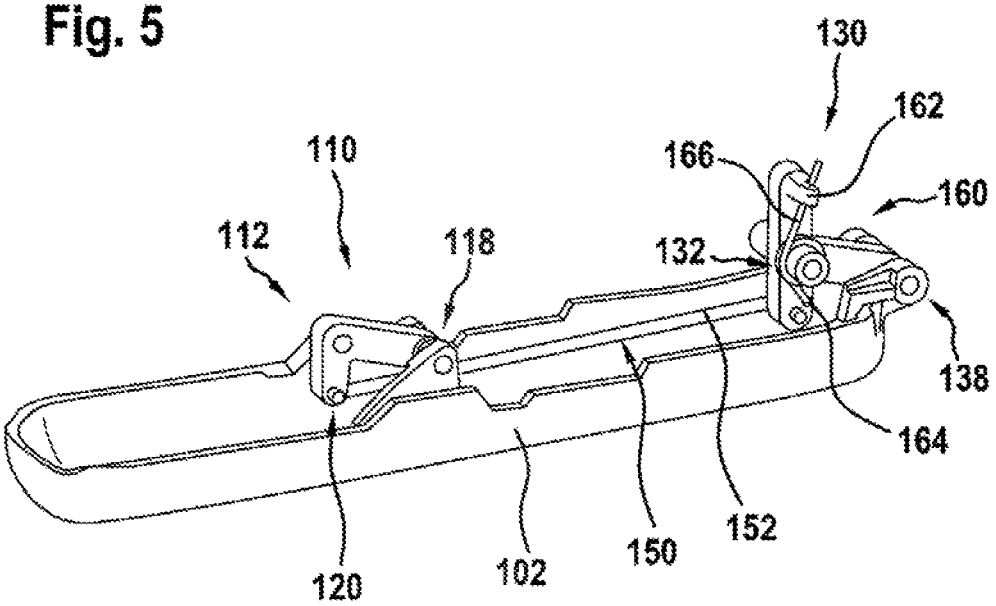
FIG. 5: shows a perspective view of a ratchet element with a first and a second pivot unit, which units are connected together by means of a coupling unit.
Figure 6:
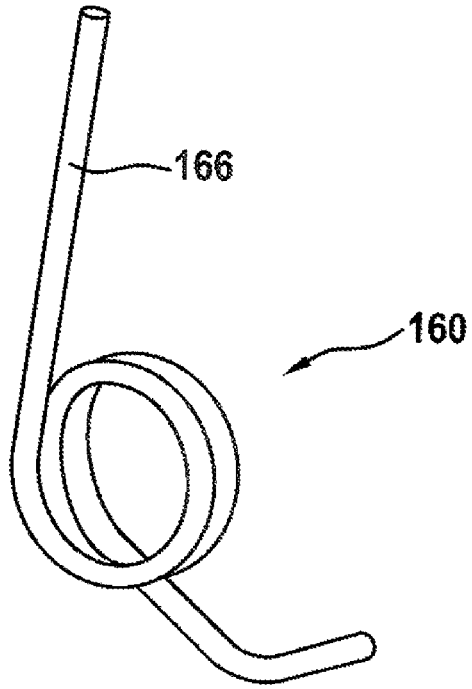
FIG. 6: shows a perspective view of a resetting unit.

FIG. 5 shows a perspective view of the ratchet element 102 and of the first and the second pivot units 110, 130, which units are connected together by means of the coupling unit 150. Additionally shown is a resetting unit 160 which is realized for the purpose of effecting a resetting force onto the ratchet element 102 in the actuated state. As a result of the resetting unit 160 and of the resetting force connected thereto, it can be ensured that the switching unit 100 is automatically displaced again into the non-actuated state without the user exerting any force on the switching element 102. Consequently, the resetting unit 160 provides a safety function in which operation of the hand-held power tool without active actuation of the ratchet element 102 is prevented. Active actuation is to be understood, in this case, as active actuation of the ratchet element 102 by an operator of the hand-held power tool 10. The resetting unit 160 is mounted advantageously so as to be movable in the second pivot unit 130. As an alternative to this, it is also conceivable for the resetting unit to be arranged in the push button 106 of the switching element 104 or between the ratchet element 102 and the motor housing 30. The resetting unit is realized, as an example, as a spring element, in particular, a leg spring 166. A perspective view of the leg spring 166 is shown in FIG. 6. The leg spring 166 is wound in a helical manner and comprises a linear end and an end which is bent in an L-shaped manner. For the bearing arrangement of the leg spring 166 in the second pivot unit 130, the helical winding of the leg spring 166 surrounds a hollow cylindrical structural element on the housing-side bearing unit 138 of the second pivot unit 130. In addition, the second pivot unit 130 comprises a stop element 162 which is provided as a stop for the linear end of the leg spring. The L-shaped end of the leg spring 166 engages in an additional receiving means 164 in the second pivot unit 130.

Figure 7:
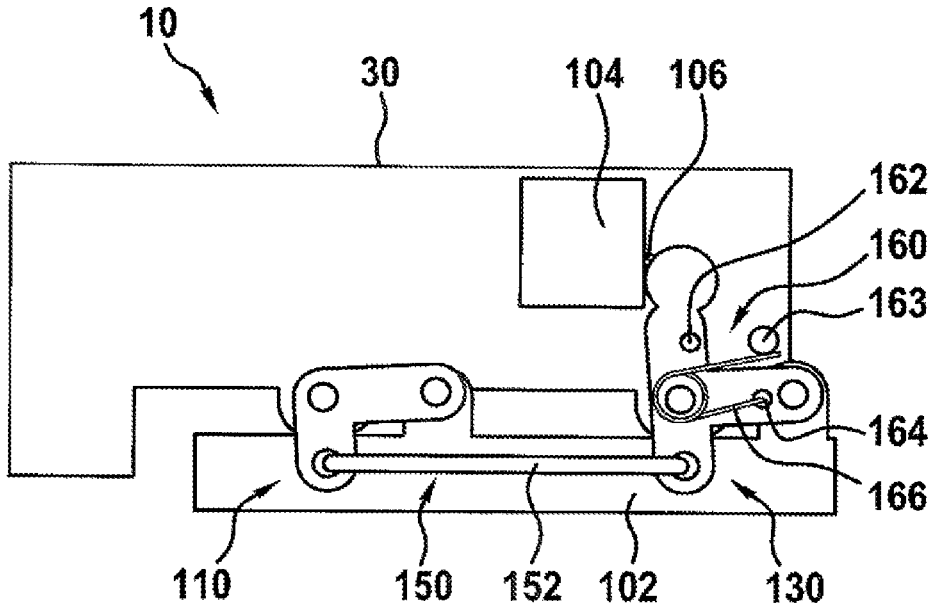
FIG. 7: shows a schematic part view of a hand-held power tool with a resetting element.

FIG. 7 shows a schematic part view of a hand-held power tool 10 with a resetting unit 160 in the actuated state. The linear end of the leg spring 166 is detached from the stop element 162 of the second pivot unit 130 in the actuated state and acts upon a stop element 163 which is connected to the motor housing 30. The leg spring is tensioned in the actuated state as a result of the deformation of the leg spring 166 against the motor-housing-side stop element 163.

Figure 8:
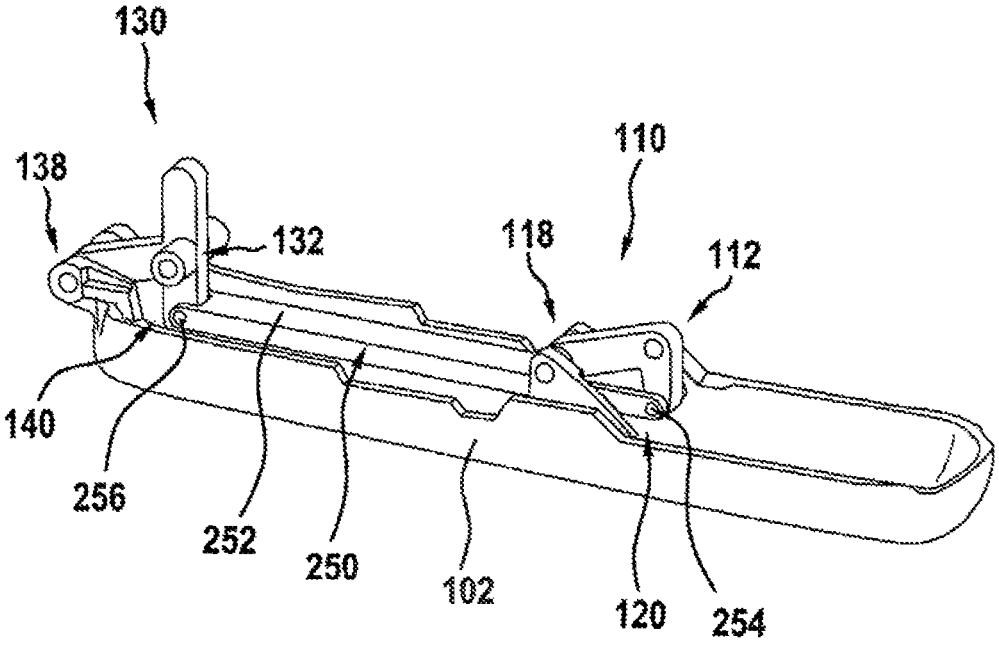
FIG. 8: shows a perspective view of a ratchet element with a first and a second pivot unit, which units are connected together by means of an alternative embodiment of a coupling unit.

FIG. 8 shows an alternative embodiment of the coupling unit 250. The coupling unit 250 is realized, as an example, as a plastics material part 252. The plastics material part 252 is realized in a rectangular manner The plastics material part comprises at its ends receiving bores 254, 256 which are realized as regards their position and size in such a manner that they are connectable by means of a pin to the further bearing units 120, 140 of the first and of the second pivot units 110, 130.

Figure 9:
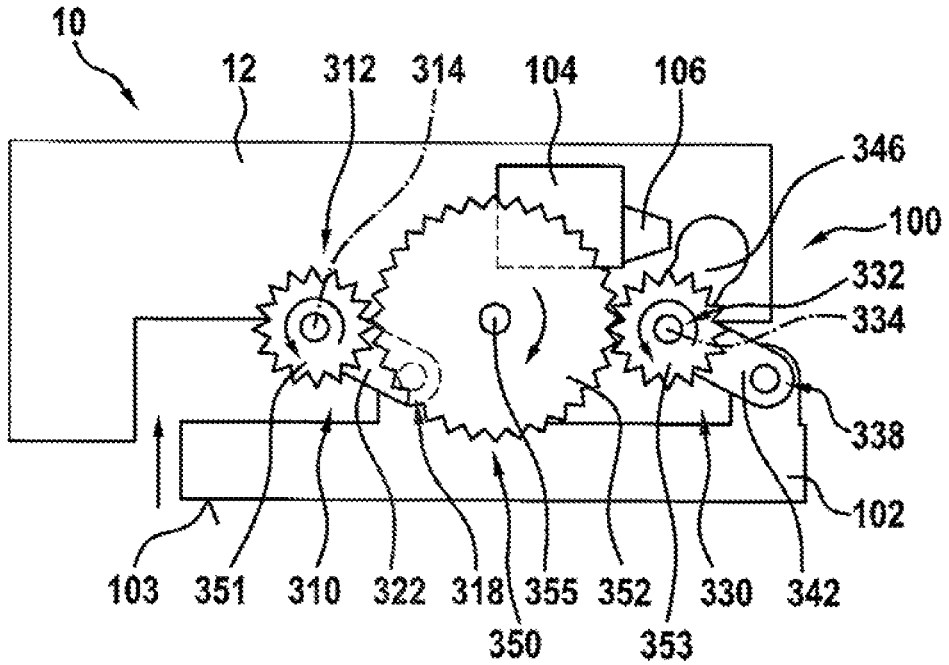
FIG. 9: shows a schematic view of a hand-held power tool with an alternative embodiment of the coupling unit in the non-actuated state.

FIG. 9 shows a schematic part view of a hand-held power tool 10 with an alternative embodiment of the coupling unit 350. The coupling unit 350 is realized, as an example, as a toothed wheel gear unit. The ratchet element 102 is connected to the housing 12 of the hand-held power tool 10 by means of a first pivot unit 310 and a second pivot unit 330. The first and second pivot units 310, 330 are rotatably connected, in an analogous manner to the embodiment from FIG. 2, to the housing 12 of the hand-held power tool 10 by means of a housing-side bearing unit 312, 332 and are rotatably connected to the ratchet element 102 of the switching unit 100 by means of a ratchet-side bearing unit 318, 338. In an analogous manner to the embodiment from FIG.

2, the first and second pivot units 310, 330 comprise a first arm 322, 342 which connects the housing-side bearing unit 312, 332 and the ratchet-side bearing unit 318, 338 together. A free end of the first arm 322, 342 of the first and of the second pivot units 310, 330 comprises in each case a toothed wheel element 351, 353. The toothed wheel elements 351, 353 are arranged, as an example, on the housing-side bearing units 312, 332 of the first and of the second pivot units 310, 330. In particular, the toothed wheel elements 351, 353 are arranged so as to be rotatable about the housing-side rotational axes 314, 334 of the first and of the second pivot units 310, 330. The toothed wheel elements 351, 353 are non-rotatably connected to the first arm 322, 342 of the first and of the second pivot units 310, 330. As an example, the toothed wheel elements 351, 353 are realized integrally with the first arm 322, 342. As an alternative to this, it is also conceivable for the toothed wheel elements 351, 353 to be arranged on the ratchet-side bearing units 318, 338 of the first and of the second pivot units 310, 330.

The coupling unit 350 comprises a coupling element 352 in the form of a toothed wheel which is arranged along the axial axis 1 of the hand-held power tool 10 between the first and the second pivot units 310, 330. In addition, the coupling unit 350 includes the toothed wheel elements 351, 353 of the first and of the second pivot units 310, 330. The coupling element 352 is rotatably connected, as an example, to the housing 12 of the hand-held power tool 10. The coupling element 352 is rotatably mounted, as an example, by means of a bolt 355 of the housing 12 of the hand-held power tool 10. The coupling element 352 is arranged in such a manner that the teeth of the coupling element 352 engage between the teeth of the toothed wheel elements 351, 353 of the first and second pivot units 310, 330. As an alternative to this, it is also conceivable for the coupling element 352 to be rotatably connected to the ratchet 102.

As an alternative to this, it is also conceivable for the coupling element 352 to be realized in the form of a toothed wheel which is formed in a flattened manner and comprises a toothing only in part along the circumference. This results in an advantageous manner in installation space being able to be saved.

As a result of actuating the ratchet element 102 of the switching unit 100, in a manner analogous to the embodiment according to FIG. 2, a movement of the ratchet element 102 is effected relative to the housing 12 of the hand-held power tool 10. As the distance between the ratchet element 102 and the housing 12 of the hand-held power tool 10 becomes smaller, a rotational movement of the toothed wheel element 351 of the first pivot unit 310 and/or of the toothed wheel element 353 of the second pivot unit 330 is effected in an anticlockwise manner (see FIGS. 9 and 10). As a result of the interlocking of the toothed wheel elements 351, 353 with the coupling element 352, a rotational movement of one of the toothed wheel elements 351, 353 is transmitted to the other toothed wheel element 351, 353 by means of the coupling element 352 which rotates in the opposite direction. The coupling element 352 couples the first and the second pivot units 310, 330 in such a manner that the first arm 322 of the first pivot unit 310 always rotates parallel to the first arm 342 of the second pivot unit 330. In particular, during actuation of the ratchet element 102, the axial distance between the housing-side bearing units 312, 332 always corresponds to the axial distance between the ratchet-side bearing units 318, 338.

Figure 10:
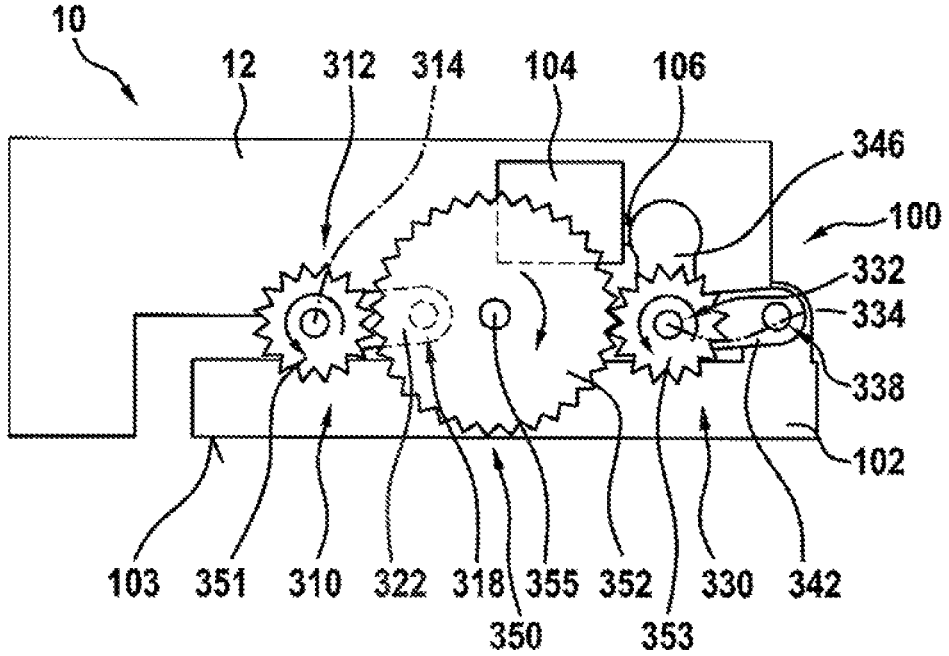
FIG. 10: shows a schematic part view of a hand-held power tool according to FIG. 9 with an alternative embodiment of the coupling unit in the actuated state.

FIG. 10 shows the coupling unit 350 from FIG. 9 in the actuated state. In the actuated state, a further arm 346 of the second pivot unit 330 acts upon the push button 106 of the switching element 104. In the actuated state, the outside contour of the housing 12 of the hand-held power tool 10 merges advantageously without a step into the outside contour of the control surface 103 of the ratchet element 102.

Figure 11:
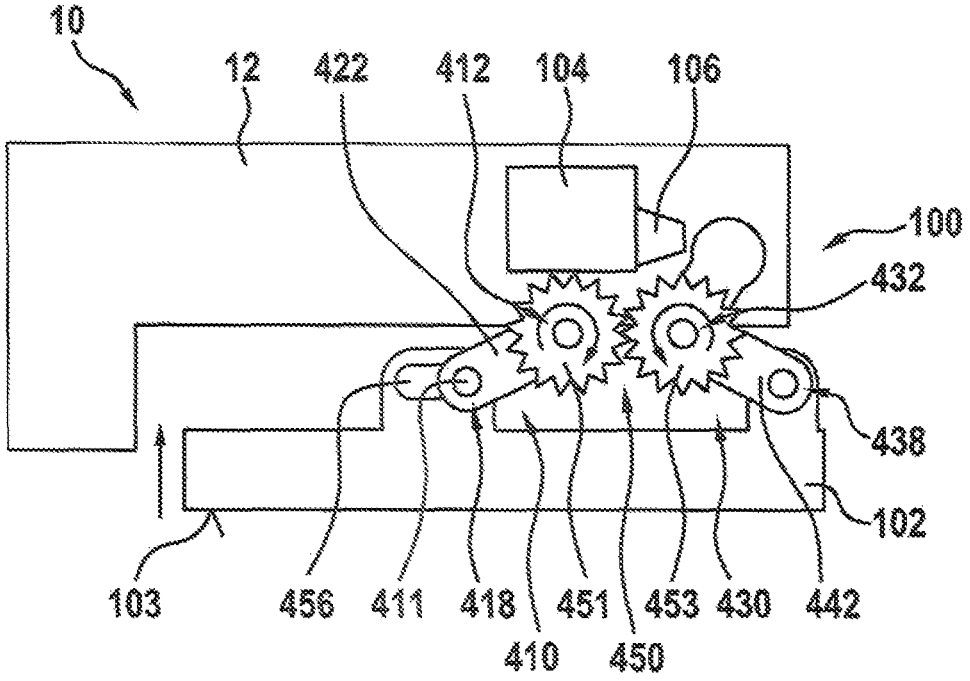
FIG. 11: shows a schematic part view of a further alternative embodiment of the coupling unit in the non-actuated state.
Figure 12:
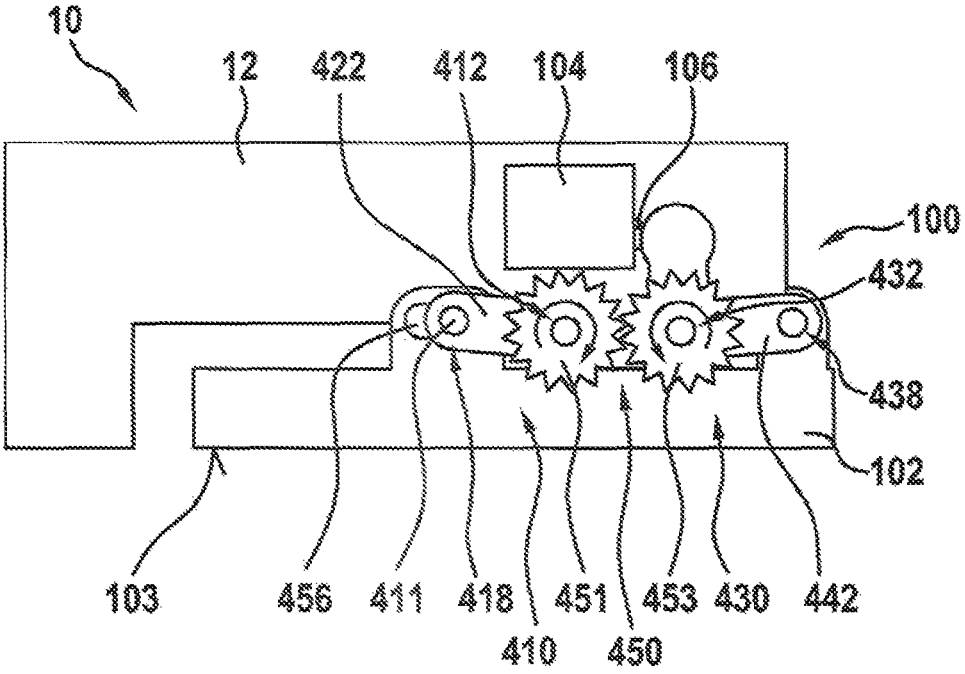
FIG. 12: shows a schematic part view of a further alternative embodiment of the coupling unit according to FIG. 11 in the actuated state.

FIG. 11 shows a schematic view of a hand-held power tool with a further alternative embodiment of the coupling unit 450 in the non-actuated state and FIG. 12 shows the actuated state. The second pivot unit 430 is realized in a manner analogous to the embodiment according to FIG. 8. The first pivot unit 410 comprises a housing-side bearing unit 412, on which is arranged, analogously to FIG. 9, a toothed wheel element 451. The teeth of the toothed wheel element 451 of the first pivot unit 410 are arranged in such a manner that they engage in the spaces between the teeth of the toothed wheel element 453 of the second pivot unit 430. In contrast to the previous embodiment, the arms 422, 442 of the first and of the second pivot units 410, 430 are not arranged parallel to one another. In particular, the axial distance between the housing-side bearing units 412, 432 is smaller than the axial distance between the ratchet-side bearing units 418, 438. When the ratchet element 102 is actuated, the first arm 422 of the first pivot unit 410 carries out a rotational movement in the opposite direction to the first arm 442 of the second pivot unit 430. The coupling unit 450 includes the toothed wheel element 451 of the first pivot unit 410 and the toothed wheel element 453 of the second pivot unit 430. The coupling unit 450 is realized for the purpose of coupling the pivot units 410, 430 in such a manner that a rotational movement of the first or second pivot unit 410, 430 brings about a rotational movement of the other pivot unit 410, 430 in the opposite direction. As the arms 422, 442 of the first and of the second pivot units 410, 430 rotate in opposite directions to one another when the ratchet element 102 is actuated, the distance between the ratchet-side bearing units 418, 438 of the first and of the second pivot units 410, 430 is modified during actuation. The ratchet-side bearing unit 418 of the first pivot unit 410 comprises a linear guide 456 which is realized for the purpose of providing the ratchet-side bearing unit 418 of the first pivot unit 410 with a further degree of freedom, in particular along the axial axis 1. The linear guide 456 is realized, as an example, as an axial groove or rather an elongated hole, by means of which a bolt 411 is mounted so as to be axially movable. In the case of an embodiment of the hand-held power tool 10 with a linear guide, it is conceivable to arrange the resetting element in the linear guide, as a result of which, once again, it is advantageously possible to save space.

Figure 13:
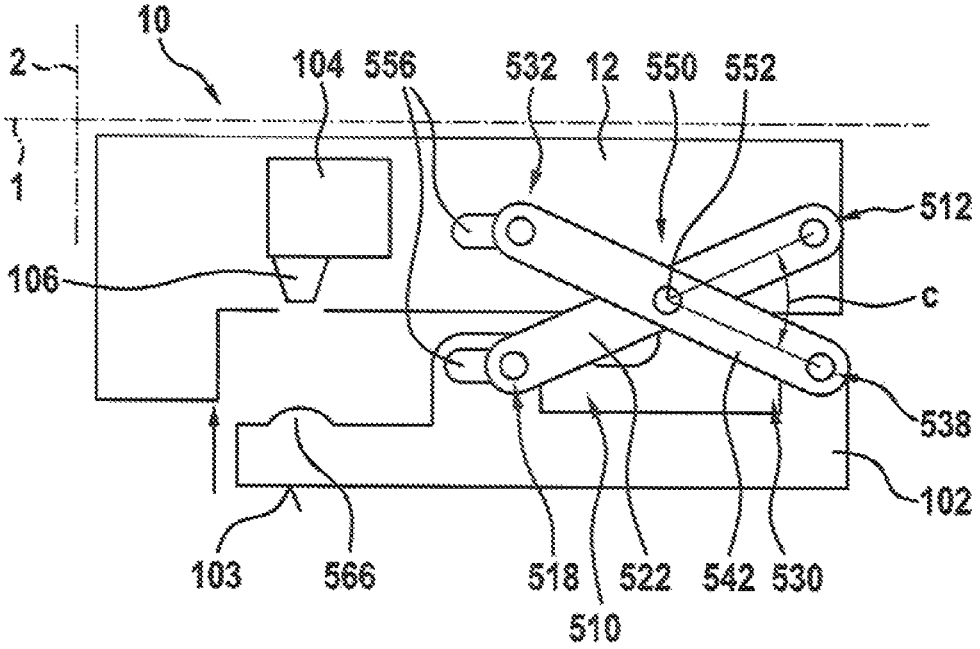
FIG. 13: shows a schematic part view of a fourth alternative embodiment of the coupling unit in the non-actuated state.
Figure 14:
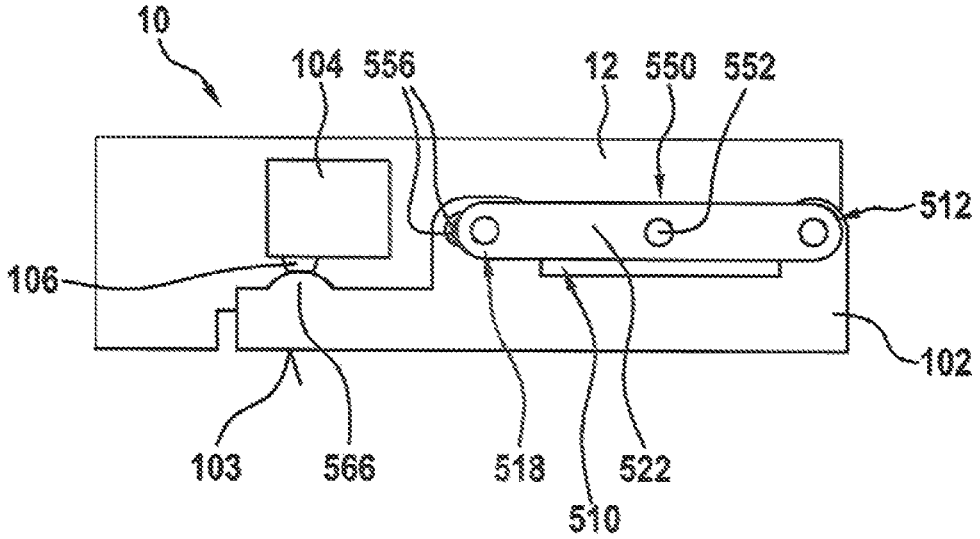
FIG. 14: shows a schematic part view of a fourth alternative embodiment of the coupling unit according to FIG. 13 in the non-actuated state.

FIG. 13 shows a schematic view of a hand-held power tool with a fourth alternative embodiment of the coupling unit 550 in the non-actuated state and FIG. 14 shows the actuated state. The coupling unit 550 is realized, as an example, as a scissors lifting unit. The ratchet element 102 is connected to the housing 12 of the hand-held power tool 10 by means of a first pivot unit 510 and a second pivot unit 530. The housing-side bearing unit 512 of the first pivot unit 510 and the housing-side bearing unit 532 of the second pivot unit 530 are advantageously arranged substantially along a parallel line to the axial axis 1 of the hand-held power tool 10. The ratchet-side bearing unit 518 of the first pivot unit 510 and the housing-side bearing unit 532 of the second pivot unit 530 are advantageously arranged substantially along a parallel line to the radial axis 2 of the hand-held power tool 10. The first arm 522 of the first pivot unit 510 is mounted so as to be movable relative to the first arm 542 of the second pivot unit 510, 530 by means of a coupling element 552. The coupling element 552 is realized, as an example, as a bolt. The coupling element 552 is fastened, as an example, on the hand-held power tool 10. The coupling element 552, in particular the bolt, extends substantially perpendicular to the axial axis 1 and perpendicular to the radial axis 2 of the hand-held power tool 10. The housing-side bearing unit 532 of the second pivot unit 530 comprises a first linear guide 556. The ratchet-side bearing unit 518 of the first pivot unit 510 comprises a second linear guide 556.

When the ratchet element 102 is actuated, a rotational movement of the first and of the second pivot units 510, 530 is effected about the coupling element 552. In this case, the distance, in particular the distance along a parallel line to the radial axis 2 of the hand-held power tool, between the housing-side bearing unit 532 of the second pivot unit 530 and the ratchet-side bearing unit 518 of the first pivot unit 510 is continuously reduced. In the actuated state, the two bearing units can overlap in a radial manner.

When the ratchet element 102 is actuated, the angle c between the first arm of the first pivot unit 510 and the first arm of the second pivot unit 530 decreases, as an example, from a value of 50° in the non-actuated state (see FIG. 13) to a value of 0° in the actuated state (see FIG. 14). In particular, the first arms 522, 542 of the first and second pivot units 510, 530 are arranged side by side in the actuated state. In the embodiment shown of the coupling unit 550 as a scissors lifting unit, at least one housing-side bearing unit 532 is mounted so as to be linearly movable relative to the housing 12 of the hand-held power tool 10. In addition, at least one ratchet-side bearing unit 518 is also mounted so as to be linearly movable relative to the ratchet 102. As an example, the ratchet element 102 has associated therewith a resetting element 566. In actuated state, the resetting element 560 acts upon the push button 106 of the switching element 104. The resetting element 560 is realized, as an example, from an elastic material in the form of a protruding lug.

Figure 15:
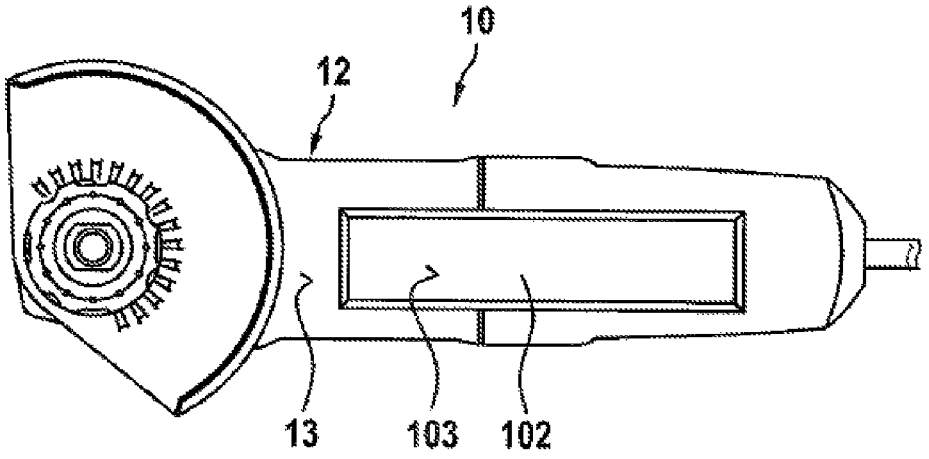
FIG. 15: shows a top view of a bottom surface of a hand-held power tool with a ratchet element.

FIG. 15 shows a top view of a bottom surface of a hand-held power tool 10 with a ratchet element 102. The ratchet element 102 comprises a substantially rectangular control surface 103. The control surface 103 has a length of approximately 45% of the axial length 3 of the hand-held power tool 10. The width of the control surface 103 is, as an example, 55% of the width of the hand-held power tool 10. Ratchet elements 102 of this size can be advantageously mounted by means of the coupling unit according to the disclosure so as to be rotatable or pivotable in such a manner that a substantially constant movement of the ratchet element is realized. As a result, the ratchet element 102 is operable equally in each grip position. In particular, there is no difference to the operator in the operation irrespective of whether he/she encompasses and operates the housing 12 of the hand-held power tool 10 on the rear end or in the front region. As a result, there is advantageously a gain in safety and comfort. The ratchet element 102 can advantageously comprise a length of at least 140 mm and at most 180 mm and a width of at least 32 mm and at most 55 mm.

What is claimed is:

1. A hand-held power tool, comprising:

a housing;

a switching unit including a ratchet element arranged on the housing;

a motor;

at least one first pivot unit and one second pivot unit, the first and second pivot units configured to mount the ratchet element on the housing of the hand-held power tool so as to be movable; and a coupling unit configured to couple the first pivot unit with the second pivot unit, wherein each of the first and the second pivot units includes at least one housing-side bearing unit and one ratchet-side bearing unit.

2. The hand-held power tool according to claim 1, wherein:

each of the first and the second pivot units includes a first arm configured to connect the housing-side bearing unit to the ratchet-side bearing unit, and the first arm of the first pivot unit and the first arm of the second pivot unit are configured such that first arm of the first pivot unit is always moved parallel to the first arm of the second pivot unit.

3. The hand-held power tool according to claim 1, wherein:

each of the first and the second pivot units includes one second arm configured to connect the housing-side bearing unit to a further bearing unit, and the further bearing unit is configured to mount the coupling unit on the first and the second pivot units.

4. The hand-held power tool according to claim 1, wherein:

an axial extent of the coupling unit corresponds to a distance between the housing-side bearing unit of the first pivot unit and the housing-side bearing unit of the second pivot unit.

5. The hand-held power tool according to claim 1, wherein:

the coupling unit is one of: a rod element, a plastics material part, and a sheet metal bending part.

6. The hand-held power tool according to claim 1, wherein:

the first and the second pivot units are rotatably mounted such that rotational movement of the first pivot unit follows rotational movement of the second pivot unit.

7. The hand-held power tool according to claim 1, wherein:

at least one of the housing-side bearing units and/or at least one of the ratchet-side bearing unit of the first pivot unit and/or the second pivot unit includes a linear guide.

8. The hand-held power tool according to claim 1, wherein:

the first pivot unit is spaced from the second pivot unit by at least a length of 25% of an axial extent of the ratchet element.

9. The hand-held power tool according to claim 1, wherein:

in at least one state of the hand-held power tool, a switching element of the switching unit is actuated in a translatory manner by the ratchet element.

10. The hand-held power tool according to claim 1, wherein:

the coupling unit includes a toothed wheel element.

11. The hand-held power tool according to claim 10, wherein:

an angle between the first arm of the first pivot unit and a radial axis of the hand-held power tool is configured to be set to a value of between 60° and 120°.

12. The hand-held power tool according to claim 11, wherein:

the value is between 70° and 110°.

13. The hand-held power tool according to claim 1, wherein:

the coupling unit is a scissors lifting unit.

14. The hand-held power tool according to claim 13, wherein:

an angle between the first arm of the first pivot unit and an axial axis of the hand-held power tool is configured to be set to a value of between 0° and 30°.

15. The hand-held power tool according to claim 14, wherein:

the value is between 0° and 20°.

16. The hand-held power tool according to claim 1, further comprising:

a resetting element configured to provide a resetting force in opposition to an actuating direction of the ratchet element, wherein the resetting element is arranged on at least one of the first pivot unit and the second pivot unit.

17. The hand-held power tool according to claim 16, wherein:

the first and the second pivot units form one structural unit with the coupling unit and with the resetting element.

18. The hand-held power tool according to claim 16, wherein:

the resetting element is a leg spring.

19. The hand-held power tool according to claim 1, wherein:

the first and the second pivot units are rotatably mounted such that rotational movement of the first pivot is effected in an opposite direction as rotational movement of the second pivot unit.

20. The hand-held power tool according to claim 1, wherein:

in at least one state of the hand-held power tool, a switching element of the switching unit is actuated in a rotational manner by at least one of the first pivot unit and the second pivot unit.

* * * * *